US006147447A

United States Patent [19]

Beunas et al.

[11] Patent Number: 6,147,447

[45] Date of Patent: Nov. 14, 2000

[54] ELECTRONIC GUN FOR MULTIBEAM ELECTRON TUBE AND MULTIBEAM ELECTRON TUBE WITH THE ELECTRON GUN

[75] Inventors: Armel Beunas, Boulogne Billancourt; Georges Faillon, Meudon la Foret, both of France

[73] Assignee: Thomson Tubes Electroniques, Meudon la Foret, France

[21] Appl. No.: 09/093,087

[22] Filed: Jun. 8, 1998

[30] Foreign Application Priority Data

Jun. 13, 1997 [FR] France ..... 97 07356

[51] Int. Cl.[7] ..... H01J 23/10

[52] U.S. Cl. ..... 313/446; 313/158; 313/442; 315/5.43

[58] Field of Search ..... 313/153, 155, 313/158, 441, 442, 443, 446; 315/5.43, 5.39

[56] References Cited

U.S. PATENT DOCUMENTS

| | | | |
|---|---|---|---|
| 3,772,554 | 11/1973 | Hughes | 313/414 |
| 3,775,635 | 11/1973 | Faillon et al. | 315/5.43 |
| 3,846,665 | 11/1974 | Firmain et al. | 315/5.43 |
| 3,896,329 | 7/1975 | Lien | 315/3.5 |
| 4,173,744 | 11/1979 | Faillon et al. | 333/33 |
| 4,243,961 | 1/1981 | Faillon et al. | 333/233 |
| 4,591,799 | 5/1986 | Faillon et al. | 333/45 |
| 4,733,131 | 3/1988 | Tran et al. | 315/5.14 |
| 4,749,906 | 6/1988 | Tran et al. | 315/5 |
| 4,827,192 | 5/1989 | Tran et al. | 315/5.39 |
| 4,933,594 | 6/1990 | Faillon et al. | 313/153 |
| 5,043,630 | 8/1991 | Faillon et al. | 315/5 |
| 5,109,179 | 4/1992 | Faillon et al. | 313/153 |
| 5,225,739 | 7/1993 | Faillon et al. | 315/5.43 |
| 5,384,513 | 1/1995 | Ji | 313/442 |
| 5,494,470 | 2/1996 | Beunas et al. | 445/35 |

FOREIGN PATENT DOCUMENTS 0 724 281 A2 7/1996 European Pat. Off. .

OTHER PUBLICATIONS

Derwent Abstracts, Accession No. 97–384105, RU2072111, Jan. 20, 1997.

*Primary Examiner*—Michael H. Day
*Assistant Examiner*—Joseph Williams
*Attorney, Agent, or Firm*—Oblon, Spivak, McClelland, Maier & Neustadt, P.C.

[57] ABSTRACT

The disclosure relates to electron guns comprising several electrodes, including a plurality of cathodes designed for the production, from an emissive face, of an electron beam each. Each of the cathodes is surrounded by a pole piece. This pole piece is designed to convey a magnetic flux close to the emissive face of the cathode. Application to longitudinal-interaction multibeam electron tubes.

20 Claims, 3 Drawing Sheets

ELECTRONIC GUN FOR MULTIBEAM ELECTRON TUBE AND MULTIBEAM ELECTRON TUBE WITH THE ELECTRON GUN

BACKGROUND OF THE INVENTION

The present invention relates to multiple-beam longitudinal-interaction electron tubes such as for example klystrons or travelling-wave tubes. These tubes which are built around a main axis comprise several longitudinal electron beams parallel to this main axis. These beams are generally produced by a common electron gun provided with several cathodes. They are collected at the end of travel in one or more collectors. Between the gun and the collector, they cross a body which is a microwave structure at whose output microwave energy is extracted. This structure may be formed by a sequence of resonant cavities in the case of a klystron or a microstrip line in the case of a travelling-wave tube. The electron beams, in order to keep their long and thin shape, are focused by a focusing device that is centered on the main axis and surrounds the microwave structure.

The advantage of multibeam electron tubes as compared with single-beam tubes is that the current produced is higher and so is the power, or else the high voltage and the length are lower.

The space requirement of the tube for equal current values is considerably smaller. The electrical supply and the modulator used are thus simplified and more compact.

The insulation in the gun can be obtained in air whereas in a single-beam tube with equivalent current, it is necessary to use oil or sulfur fluoride or any other insulating medium.

The interaction yield is improved owing to the generally lower perveance of each of the beams.

The passband of the multibeam klystrons is widened because the cavities are charged with higher current than in the single-beam configuration.

As compared with single-beam tubes, the major drawback is that it is difficult to generate an optimum focusing magnetic field. This is due especially to the fact that there is an absence of symmetry of revolution between the focusing device and each of the beams. The axial magnetic field produced by the focusing device is not axisymmetrical with respect to the axis of each of the beams. In a single-beam tube, the axis of the focusing device is merged with that of the electron beam and the axial magnetic field that it produces has a symmetry of revolution around the axis of the beam.

Another reason is that it is difficult to make a gun so that it will produce appropriate electron beams. The electron beams must be as close as possible to the main axis of the tube in order to reduce the defocusing radial magnetic fields which increase with distance from the main axis. However, the closer we come to this axis the smaller is the amount of space available. The cathodes therefore need to be very close to one another and must have a small surface area.

In the case of the klystrons, the distance between two neighboring beams is dictated by the geometry of the cavities, the diameter of the drift tubes between two cavities and the mode in the cavity.

The fact of seeking to bring the electron beams together makes it necessary for the cathodes to have a small emissive surface and a very great current density, thus considerably reducing their lifetime. Compromises between all these constraints have to be obtained.

To enable an increase in the distance between the cathodes and a reduction of their current density without placing the beams at a distance from the main axis, it has been proposed to position the cathodes on the concave part of a generally spherical cap. Their current density may be reduced and the electron beams may converge towards the body of the tube.

A ring-shaped pole piece generally surrounds the gun at the level of all the cathodes. Locally, the axial magnetic field is not symmetrical with the axis of each of the beams and the beams undergo a deflection and may be intercepted by the walls of the drift tubes and of the cavities. This arrangement is appropriate only for low-convergent cathodes.

The present invention seeks to optimize the magnetic field of a multibeam electron tube, especially in the vicinity of its cathodes so that the risks of interception are reduced.

SUMMARY OF THE INVENTION

To achieve this result, the present invention proposes an electron gun comprising several electrodes including a plurality of cathodes designed for the emission, from an emissive face, of an electron beam each. Each cathode has, in its vicinity, a pole piece that surrounds it. This pole piece made of magnetic material is designed to convey a magnetic flux close to the emissive face of the cathode so that the magnetic flux lines substantially match the path of the electrons of the beam as soon as they are emitted.

To simplify the manufacture, it is advantageous that the pole pieces should be fixedly joined to one another so as to form a pole piece common with apertures for the housing of cathodes therein.

To improve the circulation of the magnetic flux, the common pole piece may comprise a flange opposite the cathodes.

Should the gun comprise a focusing electrode, this electrode may form, in the vicinity of the cathodes, a coating of the pole pieces or of the common pole piece.

The pole pieces or the common pole piece may advantageously be made of a nickel-iron based alloy so as to withstand high temperature and so as to release little gas.

An element for the production of the magnetic field such as a coil or a magnet may work together with the pole pieces or the common pole piece so as to enable an adjustment of the magnetic flux in the vicinity of the cathode.

It is advantageous, in the vicinity of the anode of the gun, to provide for an anode pole piece so that the beams preserve the characteristics required further down in the tube. This anode pole piece is crossed by the beams. It may even be integrated into the anode. In this configuration, the anode is then partially or totally made of magnetic material.

The present invention also relates to a multibeam electron tube comprising a body surrounded by a focusing device and an electronic gun as described here above, connected to the body.

In order that the electron beams may keep the characteristics required in the body, it is possible for the body to comprise at least one additional pole piece crossed by the electron beams.

This pole piece extends magnetically into the focusing device.

If the focusing device has a sequence of elements producing a magnetic field, the additional pole piece may be inserted between two elements of the sequence.

BRIEF DESCRIPTION OF THE DRAWINGS

Other features and advantages of the invention shall appear from the following description of exemplary embodiments illustrated by the appended drawings, of which:

FIG. 1 gives a longitudinal sectional view of a gun of an electron tube according to the invention. This gun designed for a multibeam electron tube built around a main axis XX' has a plurality of cathodes 1. Each cathode 1 has an emissive element 11 having a face 10 emitting an electron beam 100 with an axis z. Each emissive element 11 is supported by a skirt 8.

Figure 1:
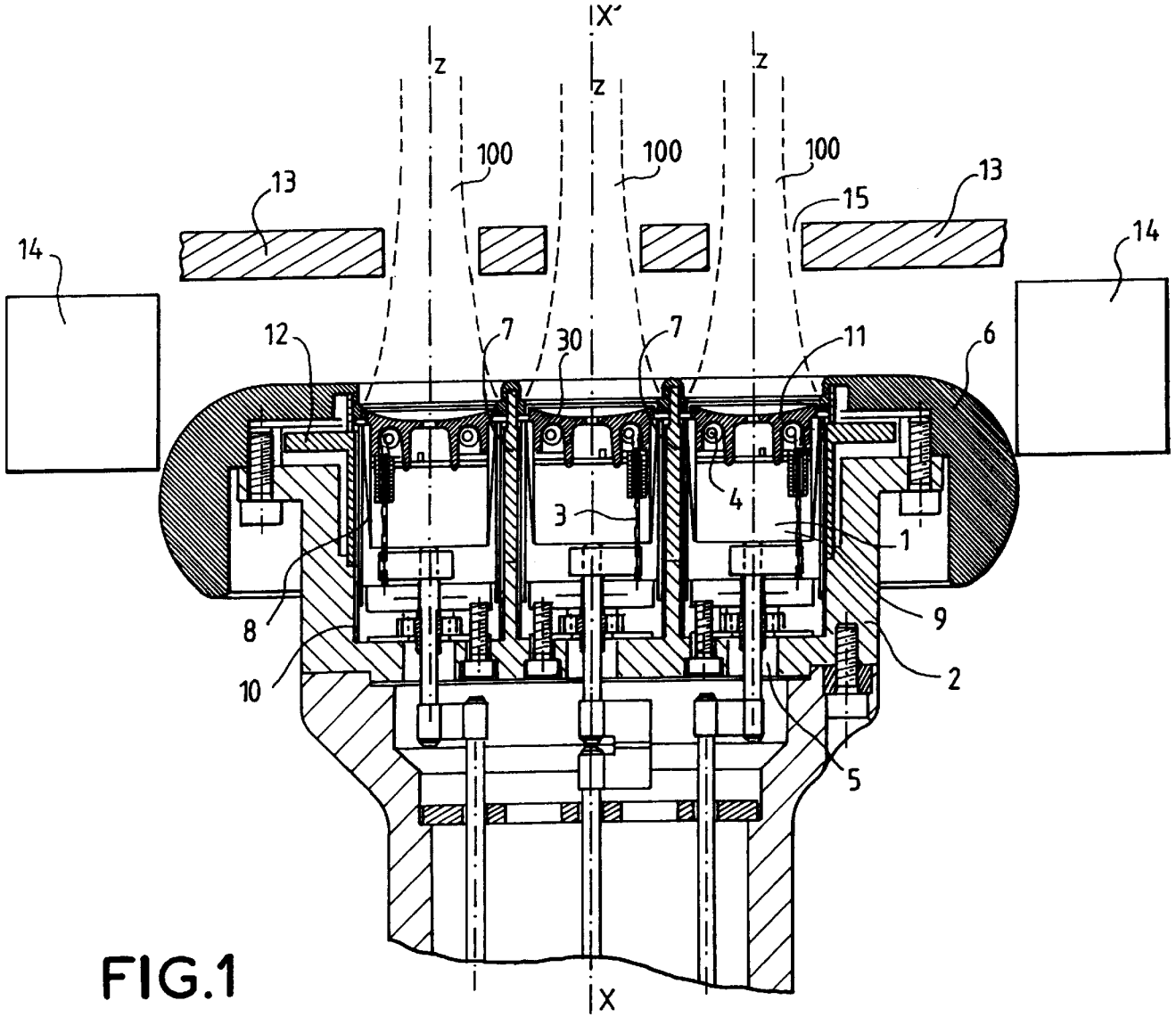
FIG. 1 shows a longitudinal sectional view of an electron beam according to the invention with a common pole piece.

In the example described, there are seven cathodes 1 six of which are positioned in a ring while one is a central cathode centered on the main axis XX'. It is possible, of course, to have another arrangement and another number of cathodes.

All the cathodes 1 are supported by a common part 2 that is relatively massive.

In a standard way, there are provided a heating device 3, cathodes 1 in the form of resistive elements 4, each of them being placed within the skirt 8 opposite the emissive face 30 of the emissive elements 11. The supporting part 2 has apertures 5 needed for the passage of conductors for the resistive elements 4.

In a standard way, the gun further comprises a focusing electrode 6 known as a Wehnelt device taken to the same potential as that of the cathodes. This common Wehnelt device 6 surrounds all the cathodes 1.

The gun also has a common anode 13 provided with apertures 15 for each of the electron beams 100.

Figure 3A:
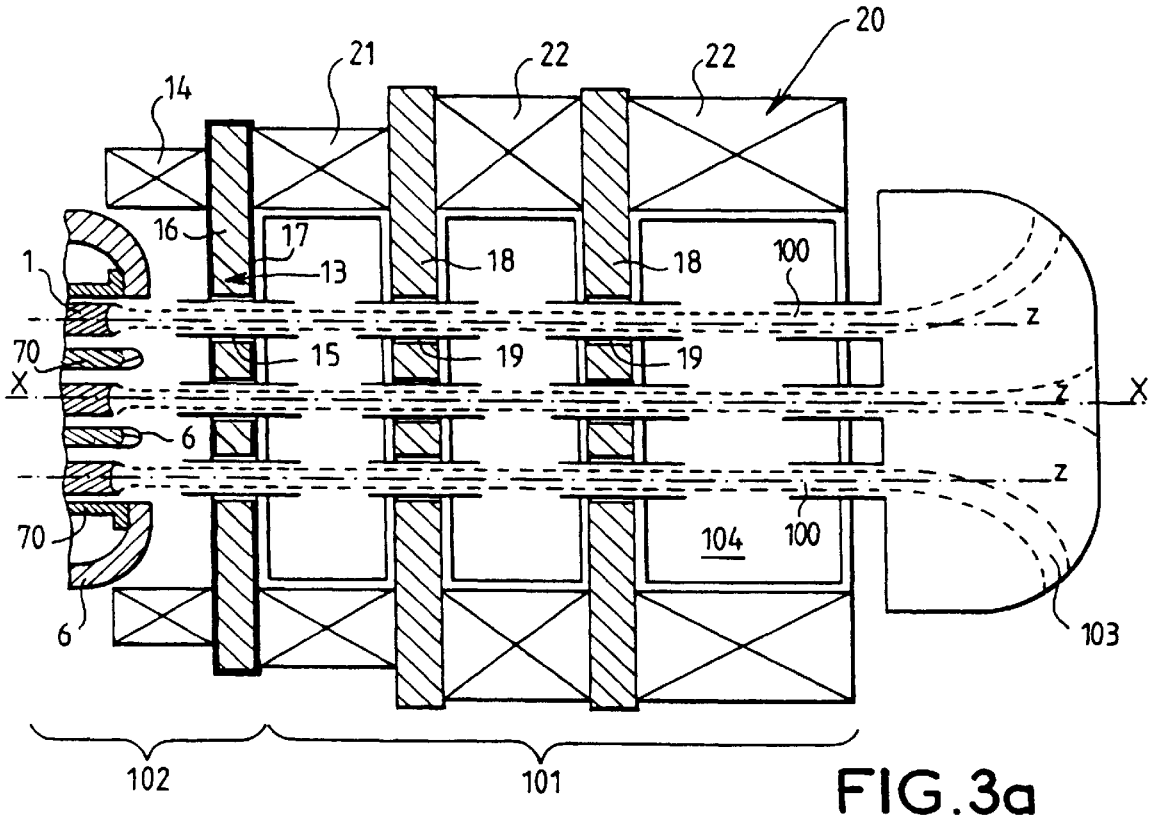
FIG. 3*a* shows a longitudinal sectional view of an electron tube according to the invention with several pole pieces.

According to the invention, each of the cathodes 1 has, in its vicinity, a pole piece 70 that surrounds it. These pole pieces 70 made of magnetic material are taken to the potential of the cathodes 1. It is this configuration that is shown in FIG. 3*a*. In order to simplify the manufacture and assembly, it is preferable that the pole pieces 70 should be fixedly joined to one another to form only one common pole piece 7 provided with apertures 9 each designed to take a cathode 1. It is this configuration that is shown in FIG. 1. The apertures 9 are substantially cylindrical and the cathodes 1 are housed within the aperture. The pole pieces 70 and the common pole piece 7 are designed to convey a magnetic flux in the vicinity of the emissive face 30 and they act on the electrons emitted at their output from the cathode. The magnetic flux lines conveyed by the pole pieces 7, 70 substantially match the path of the electrons emitted by the emissive elements 11. The electron beams 100 are well formed and the risks of interception are reduced to the utmost.

The pole pieces 70, 7 are in contact with the supporting piece 2 of the cathodes 1. This contact enables heat to be removed to the supporting part 2.

Hereinafter, everything that is said about the pole piece 7 also applies to the pole pieces 70 unless the contrary is stated.

It is seen to it that the temperature of the pole piece 7 does not exceed approximately 400° C. and that in any case it is far below the Curie temperature of the magnetic material forming it.

The common pole piece 7 may be made of material based on a ferrous alloy chosen for minimum release of gas under heat. Alloys of this kind are of the iron-nickel or iron-nickel-cobalt type, for example. The Curie temperature of this type of alloy is about 750° C.

To prevent the temperature of the common pole piece 7 from becoming excessive, it is seen to it that it is not in contact with the skirt 8 of the cathodes. This skirt 8 is a generally cylindrical part.

To further limit the temperature of the common pole piece 7, it is possible to interpose a heat screen 10 between each of the cathodes 1 and the common pole piece 7. This screen 10 in contact with the supporting part 2 preferably has no contact with the common pole piece 7. It may be made of a material that is a good conductor of heat such as copper.

Figure 2B:
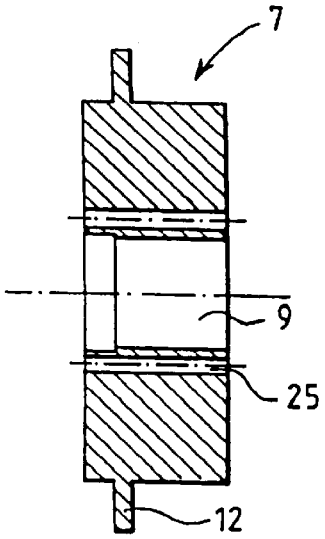
FIGS. 2*a,* 2*b,* 2*c* show a front view and two sectional views of a common pole piece.
Figure 2A:
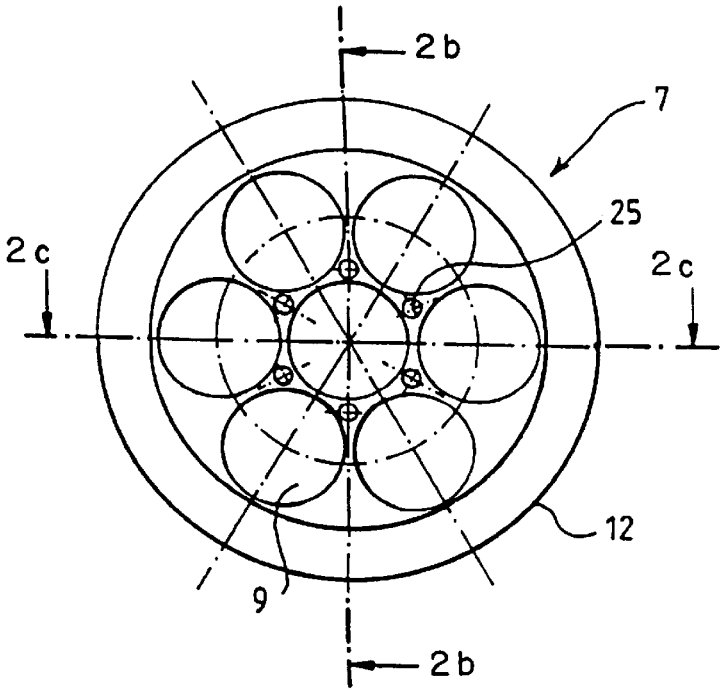
Figure 2C:
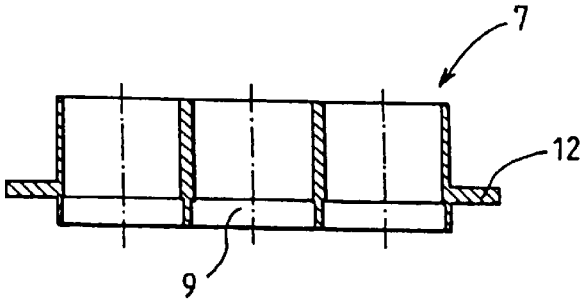

A common pole piece 7 is shown in FIGS. 2*a,* 2*b,* 2*c*. The description of these figures relates only to the common pole piece 7. This common pole piece 7 is on the whole shaped like a disk with holes. Apertures 9 are provided to house the cathodes. Holes 25 may be provided to receive fastening screws for attachment to the supporting part 2. To simplify the embodiment, it can be imagined that the common pole piece 7 is fixedly joined to the Wehnelt device 6. In FIG. 1, the cathodes 1 are relatively close to each other and the Wehnelt device 6 is represented around each of the emissive elements 11 on the edge of the apertures 9 like a coating of the common pole piece 7. This coating may be made of copper or of molybdenum for example.

Also in FIG. 3*a,* the Wehnelt device 6 forms, in the vicinity of each of the cathodes 1, a coating of the pole pieces 70.

The common pole piece 7 may comprise, on its periphery, as shown clearly in FIGS. 2*a,* 2*b,* 2*c,* a flange 12 that extends in a direction opposite the cathodes 1 and is given dimensions, especially in thickness, to provide for optimum circulation of the magnetic flux through the Wehnelt device 6 towards the focusing device 20 that produces this flux and surrounds the body of the multibeam tube to which the gun must be connected.

Figure 3B:
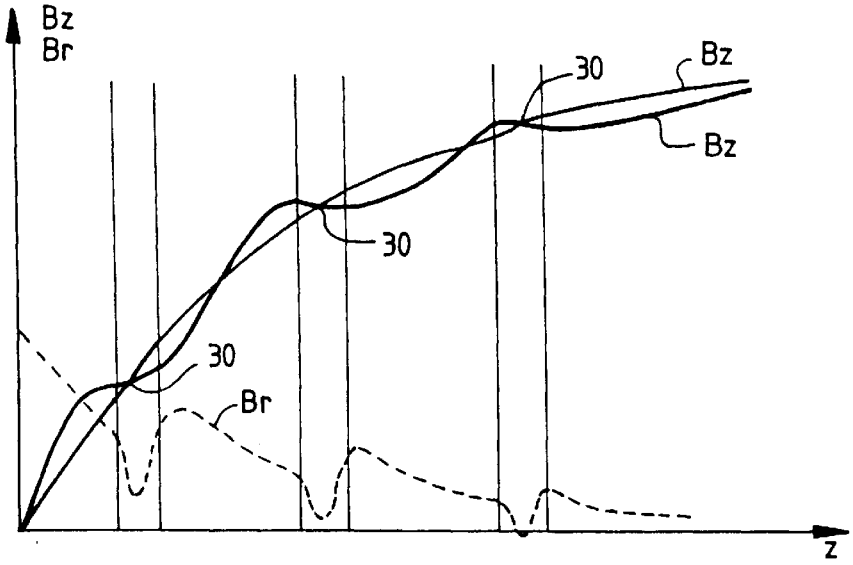
FIG. 3*b* shows the axial magnetic field and the radial magnetic field along an electron beam of the tube of FIG. 3*a*.

With a pole piece 7 of this kind, the axial magnetic field Bz is almost identical in the vicinity of each of the cathodes 1 and is very close to the one obtained in the single-beam tube as shown in FIG. 3*b* described further above. Furthermore, in the vicinity of the cathodes 1, the magnetic field has an almost symmetrical profile with respect to the axis z of each of the beams and its radial component is low enough not to cause any substantial deflection of the electrons and therefore any unwanted interception.

In order to obtain the most efficient adjustment of the magnetic field in the vicinity of the cathodes, it can be planned to surround all the cathodes with an element 14 for the production of an annular magnetic field. This element is preferably a coil. By adjusting the electrical current that supplies it, it is possible to obtain a magnetic field profile that approaches the desired theoretical profile to an even greater extent. A permanent magnet may also be used instead of the coil.

In order that the beams may preserve the characteristics required further below for the cathodes, it can be planned to place an anode pole piece 16 crossed by the beams 100 in the vicinity of the anode 13. It is advantageous that the anode pole piece 16 should be integrated with the anode 13. For this purpose, the anode 13 may be made partially or totally out of magnetic material.

In FIG. 1, it is made totally out of magnetic material.

This material may be for example soft iron or soft steel. In FIG. 3*a* it is made partially out of magnetic material.

It has as many apertures 15 as electron beams 100 and on the whole has the shape of a plate that is substantially normal to the electron beams. It has a core 16 of magnetic material such as soft iron or soft steel and a coating 17 in the vicinity of the apertures 15 made of a non-magnetic material such as copper or molybdenum. Through the core 16 made of magnetic material, the anode 13 plays the role of a pole piece designed to convey a magnetic flux to the vicinity of the electron beams so that the magnetic flux lines prevent the electrons from being deflected and therefore being intercepted.

The present invention also relates to an electron tube comprising a gun 102 as described here above wherein the magnetic field is optimized. This electron tube, built around an axis XX' schematically shown in FIG. 3*a,* has a body 101 connected by one side to the gun and by the other side to a collector 103 in which there are collected the electron beams 100. The body 101 of the tube is shown as a succession of resonant cavities 104. The body 101 is surrounded by a focusing device 20. The optimizing of the magnetic field is achieved by at least one additional pole piece 18 placed in the body 101.

The additional part 18 which is substantially normal to the electron beam 100 is provided with apertures 19 for each of the beams.

This additional pole piece 18 made of magnetic material has the role in particular of making the magnetic flux lines more parallel to the main axis XX' of the tube at the level of the different electron beams 100, thus preventing the electrons from being deflected.

If several additional pole pieces 18 are used, as shown in FIG. 3*a,* it is preferable to place them relatively close to one another so that the magnetic field remains parallel to the main axis XX' of the tube.

It is seen to it that each aperture 19 is centered on the axis z of an electronic tube 100. Indeed, in the vicinity of an electron beam 100, the magnetic field has a deformation but this deformation is one generated by revolution around the axis z of the electron beam 100 and this deformation has no defocusing effect on the electron beam 100.

It is advantageous that the additional pole pieces 18 should extend magnetically into the focusing device 20 to further reduce the radial magnetic field. Similarly, the anode pole piece 16 may extend up to the focusing device 20.

In the example of FIG. 3*a,* the focusing device 20 is formed by a sequence of elements 21, 22 producing a magnetic field. These elements 21, 22 may be of the coil or magnet type for example. The first element 21 is placed at the input of the focusing device 20, between the anode 13 which integrates the anode pole piece 16 and the first additional pole piece 18. The other elements 22 follow an additional pole piece 18. The additional pole pieces 18 are inserted between two elements 21, 22 producing a magnetic field. It is assumed that the elements 22 following an additional pole piece 18 are of the coil type. They may advantageously be supplied with one and the same electrical current so as to produce a substantially constant magnetic field along the body 101, this constancy enabling the radial magnetic field to be substantially zero.

FIG. 3*b* shows firstly the radial magnetic field Br in dashes and the axial magnetic field Bz in bold lines. These fields exist along an electron beam 100 of the tube of FIG. 3*a*. Secondly FIG. 3*b,* in a thin line, shows the theoretically axial magnetic field Bz that exists along the beam of a comparable single-beam tube.

The curve drawn in a bold line is close to that of the thin line because of the flat portions 30 placed at the level of the anode pole piece 16 and the additional pole piece 18. These level portions 30 bring the bold curve back towards the position of the thin curve.

As for the radial magnetic curve Br it diminishes with distance from the cathode 1 following the path of the beam 100. Its defocusing effect is negligible.

In the example shown, the cathodes 1 have been shown in one and the same plane. It is clear that they could be positioned on a concave surface.

What is claimed is:

1. An electron gun comprising:

a plurality of electrodes, including, a plurality of cathodes, each having an emissive face configured to produce an electron beam; and a plurality of pole pieces being made of a magnetic material, respective of the plurality of cathodes being surrounded by and in a vicinity of a corresponding one of the plurality of pole pieces and the corresponding pole piece being configured to convey a magnetic flux close to the emissive face of the respective cathode, wherein, magnetic flux lines of the magnetic flux conveyed by the corresponding pole piece substantially match an orientation of a path of electrons from the electron beam emitted by the emissive face of the respective cathode so as to focus the electron beam after emission.

2. The electron gun of claim 1, wherein:

the plurality of pole pieces being fixedly joined to one another to form a common pole piece with apertures therein configured to house the plurality of cathodes.

3. The electron gun of claim 2, wherein:

the common pole piece having a flange on a periphery thereof.

4. The electron gun of claim 2, further comprising:

a focusing electrode positioned in a vicinity of the plurality of cathodes, and being formed as a coating of the common pole piece.

5. The electron gun of claim 2, wherein, the common pole piece comprises an iron-nickel material.

6. The electron gun of claim 2, further comprising:

an adjustable magnetic field producing device configured to produce an annular magnetic field configured to work with the common pole piece to adjust the magnetic flux close to the emissive faces of the plurality of cathodes.

7. The electron gun of claim 6, wherein:

the adjustable magnetic field producing device comprises a coil.

8. The electron gun of claim 6, wherein:

the adjustable magnetic field producing device comprises a permanent magnet.

9. The electron gun of claim 1, further comprising:

a focusing electrode positioned in a vicinity of the plurality of cathodes, and being formed as a coating on the plurality of pole pieces.

10. The electron gun of claim 1, wherein, the plurality of pole pieces comprises an iron-nickel material.

11. The electron gun of claim 1, further comprising:

an adjustable magnetic field producing device configured to produce an annular magnetic field configured to cooperate with said plurality of pole pieces to adjust the magnetic flux close to the emissive faces of the plurality of cathodes.

12. The electron gun of claim 11, wherein:

the adjustable magnetic field producing device comprises a coil.

13. The electron gun of claim 11, wherein:

the adjustable magnetic field producing device comprises a permanent magnet.

14. The electron gun of claim 1, further comprising:

an anode; and an anode pole piece configured to be crossed by each of the electron beams close to the anode.

15. The electron gun of claim 14, wherein:

the anode pole piece and the anode being integrated to form an integrated anode.

16. The electron gun of claim 15, wherein:

the integrated anode at least partially comprises a magnetic material.

17. A multibeam electron tube comprising:

a body;

a focusing device configured to surround the body; and an electron gun connected to the body comprising, a plurality of electrodes, including, a plurality of cathodes, each having an emissive face configured to produce an electron beam, and a plurality of pole pieces being made of a magnetic material, respective of the plurality of cathodes being surrounded by and in a vicinity of a corresponding one of the plurality of pole pieces and the corresponding pole piece being configured to convey a magnetic flux close to the emissive face of the respective cathode, wherein, magnetic flux lines of the magnetic flux conveyed by the corresponding pole piece substantially match an orientation of a path of electrons from the electron beam emitted by the emissive face of the respective cathode so as to focus the electron beam after emission.

18. The tube of claim 17, further comprising:

at least one additional pole piece within the body configured to be crossed by each of the electron beams.

19. The tube of claim 18, wherein:

the additional pole piece being configured to extend magnetically into the focusing device.

20. The tube of claim 19, wherein:

the focusing device comprises a sequence of magnetic field producing elements, and the additional pole piece being inserted between two elements of the sequence.

* * * * *